United States Patent [19]

Harper, Jr.

[11] Patent Number: 4,711,640

[45] Date of Patent: Dec. 8, 1987

[54] PROCESS FOR CROSSDYEING CELLULOSIC FABRICS

[75] Inventor: Robert J. Harper, Jr., Metairie, La.

[73] Assignee: The United States of America as represented by the Secretary of Agriculture, Washington, D.C.

[21] Appl. No.: 878,106

[22] Filed: Jun. 25, 1986

[51] Int. Cl.[4] ..... D06P 5/00

[52] U.S. Cl. ..... 8/481; 8/480; 8/485; 8/185; 8/188

[58] Field of Search ..... 8/480, 481, 485, 188, 8/185, 187

[56] References Cited

U.S. PATENT DOCUMENTS

| | | | |
|---|---|---|---|
| 3,755,046 | 11/1973 | Harper, Jr. et al. | 156/429 |
| 3,800,375 | 4/1974 | Harper, Jr. et al. | 8/481 |
| 3,847,542 | 11/1974 | Harper, Jr. et al. | 425/198 |
| 3,960,477 | 6/1976 | Harper, Jr. et al. | 8/449 |

FOREIGN PATENT DOCUMENTS

| | | | |
|---|---|---|---|
| 0231878 | 11/1985 | Japan | 8/481 |

*Primary Examiner*—Paul Lieberman
*Assistant Examiner*—John F. McNally
*Attorney, Agent, or Firm*—M. Howard Silverstein; Raymond C. Von Bodungen; David G. McConnell

[57] ABSTRACT

Processes for producing multicolor crossdyed cellulosic fabrics which are fully or partly crosslinked are disclosed. These processes include: (1) crosslinking preselected areas of fabric with a grafted cationic group and leaving other areas untreated; immersing the fabric in an acidic anionic dyebath to dye the cationic areas and then immersing in a different colored, alkaline, unreactive dyestuff dyebath to dye the untreated areas and produce a bicolored fabric, (2) crosslinking fabric areas with a grafter cationic group and then the remaining areas with an anionic group; immersing in an acidic, anionic dyebath to dye the cationic areas and the immersing in a different colored cationic dyebath to dye the anionic areas and produce bicolored fabric, and (3) preselecting and treating areas of fabric to be cationic, anionic and untreated; immersion dyeing as above the cationic, untreated and then the anionic areas of fabric to produce a multicolored fabric.

23 Claims, No Drawings

PROCESS FOR CROSSDYEING CELLULOSIC FABRICS

FIELD OF THE INVENTION

This invention relates to processes for producing multicolor crossdyeing of cellulosic fabrics.

DESCRIPTION OF THE PRIOR ART

Crossdyeing is a process whereby a fabric can be dyed more than one color by successive immersions (piece dyeing). For example, a composite fabric can be prepared with a standard polyester dyeable with dispersed dyes for certain yarns and a different polyester dyeable with basic dyes for other yarns. Then, by immersion or piece dyeing, the fabrics can be dyed with both disperse and basic dyes. By proper selection and placement of these fibers in the fabric, crossdye effects were readily achieved. However, cotton is not readily crossdyed.

Processes to produce multicolor crossdyeable cotton have usually been based upon developing procedures involving non-cotton dyes or involve an extensive dyeing-finishing process. Thus, U.S. Pat. No. 3,775,046 concerns fabrics which comprise both treated and untreated areas and therefore teaches either the use of a polymer or a polymer and crosslinking agent to make treated regions of the cotton fabric dyeable with a disperse dyestuff while the untreated areas of the fabric are dyed with a cotton dyestuff. This process suffers serious limitations because disperse dyestuffs are only absorbed on fabric surface areas where polymer is deposited, thereby leading to lightfastness and associated problems. A similar limitation applies to U.S. Pat. No. 3,800,375 which likewise is based upon dyeing of polymer treated yarns with a disperse dyestuff. Two other patents, U.S. Pat. No. 3,847,542 and U.S. Pat. No. 3,960,477 are based upon treating segments of fabric with easily hydrolyzed crosslinking agents; dyeing the fabric with one color; hydrolyzing the crosslinking agent; and then, redyeing the fabric with a second color. While these patents would permit crossdyeing the overall fabric with cotton dyes; the extended process of applying agent and hydrolyzing same is not only expensive but cumbersome and does not produce multicolored partly crosslinked cotton fabrics.

SUMMARY OF THE INVENTION

This invention relates to process for producing multicolored crossdyed cellulosic fabric which are either fully or partly crosslinked. Said processes are based upon sequential immersion dyeing of cellulosic fabrics in which certain fabric segments using either treated yarns or fabric segments are: (1) crosslinked with a grafted cationic group; (2) crosslinked with a grafted anionic group and (3) unmodified or base treated. One process comprises treating preselected areas of a cellulosic fabric with an aqueous cationic solution with sufficient time and temperature to impart cationic properties to the treated area of the fabric. The fabric is then immersed in an acidic dyebath containing an anionic dye for sufficient time to allow the anionic dye to react with the cationic areas, thereby producing a fabric dyed in the treated areas. The fabric is washed to remove unreacted dyestuff and then immersed in an alkaline dyebath containing a reactive dyestuff of different color from the previous dye step for sufficient time to dye the fabric and thereby produce a crosslinked bicolored fabric.

A second process utilizes the same cationic areas of the first process and then treats the remaining areas of the fabric with an aqueous anionic solution of sufficient concentrations of N-methylol crosslinking agent, acid catalyst and hydroxy cabrboxylic to render these areas anionic after drying and curing. The fabric is then immersed in an acidic dyebath containing an anionic dye for sufficient time to react the anionic dye with the cationic areas and produce a fabric colored in the cationic areas. The fabric is again immersed in another dyebath containing a cationic dye of a different color for sufficient time to allow the cationic dye to react with the anionic areas and thereby produce a bicolored crosslinked fabric.

In the third process fabric areas are preselected to be treated as cationic, anionic and untreated. The same cationic treatment used in the first process is followed to produce cationic areas. The same treatment used in the second process is followed to produce anionic areas, and the remainder of the fabric is left untreated. Then, the same procedures used in the first process for immerse dying are followed to dye both the cationic and untreated areas. Finally, the same procedure used in the second process is followed for immerse dyeing the anionic areas. This results in a partially crosslinked tricolored fabric.

DESCRIPTION OF THE PREFERRED EMBODIMENTS

A process for multicolor crossdyeing of partly or fully crosslinked cellulosic fabrics is disclosed. This process is based upon sequential immersion dyeing of cellulosic fabrics in which certain fabric segments (either by yarn or fabric treatments are: (1) crosslinked with a grafted cationic group; (2) crosslinked with a grafted anionic group and (3) unmodified or base treated. The specific combinations employed 1 & 3, 1 & 2 and 1, 2, and 3.

In the case of fabric containing cationic and unmodified cotton (1 & 3) the fabric is dyed with a dyestuff containing an anionic group such as a reactive, direct or acid dye under mildly acidic conditions. Under these conditions, the untreated cotton is nearly dye resist while these cationic cotton area dyes deeply. Then, the fabric is dyed with reactive dye (second color) under alkaline conditions. Under these conditions both the cationic and unmodified cotton are dyed with the second color. As such, the cationic fabric segments are dyed with both colors (but usually more so in first dyeing) and the unmodified cotton is dyed only in the second dyeing.

In another variation of this process, certain yarns or segments of the cellulosic fabric are crosslinked with a grafted cationic group and others crosslinked with a grafted anionic group (case 1 & 2). When the fabric is dyed with an anionic dyestuff such as reactive, direct or acid dyes under acidic conditions; the cationic cellulose is deeply dyed while the anionic segment is dye resist. If the fabric is then dyed with a different color using a cationic dye (which has both cationic and anionic groups) then this dyestuff dyes both the cationic and anionic cellulosic areas of the fabric. The result therefore is that the cationic fabric areas are dyed with both colors whereas the anionic fabric areas are dyed only with the second color.

It is possible to utilize a three color approach if one employs yarns or segment treatments in one fabric involving the three types of treatment described heretofore namely (1) crosslinked cellulose with a grafted quaternary group; (2) crosslinked cellulose with a grafted anionic group; and (3) unmodified cellulose. With a fabric such as this, dyeing with anionic dyestuff under acidic conditions dyes primarily the cationic cellulose segments or yarns; dyeing with a cationic dyestuff (contains both cationic and anionic groups) dyes both the cationic and anionic segments, while the untreated cellulose is nearly dye resist and finally, dyeing with a reactive dye under conventional (alkaline conditions) dyes both the unmodified cellulose and cationic cellulose. Thus by proper selection dyestuffs and colors, a three color combination can be achieved. Or conversely, one might dye with two colors and leave the crosslinked fabric with the grafted anionic groups undyed by eliminating dyeing with the cationic dyestuff.

In the preferred embodiments, the specific approach of making cotton yarns or fabric segments cationic would be to treat said yarns or fabric areas with a formulation containing crosslinking agent, acid catalyst and a reactive additive, choline chloride. Once this formulation is cured on the fabric the fabric yarns or areas so treated are crosslinked with a grafted cationic group. Almost all crosslinking agents can be used for this purpose but particularly effective agents are those that have more than two reactive sites, such as dimethylol dihydroxyethyleneurea (DMDHEU), its methoxylated counterparts, trimethylol acetylenediureine (3 ACD), tetramethylol acetylenediureine (4 ACD), methylol melamines (TMM) and methoxylated melamines and methylol dicarbamates derived from pentaerythritol. If proper adjustments are made in reaction concentrations, difunctional agents such as dimethyol propylcarbamate (DMPC) can also be used.

The acid catalysts used for these formulations include all such catalysts as might be employed by one skilled in the art of crosslinking cellulose. Examples of such catalysts are zinc nitrate hexahytdrate, magnesium chloride hexahydrate, and mixed catatysts derived from magnesium chloride and strong acids such as citric acid or aluminum chlorhydroxide.

Choline chloride is used as a reactive additive to make the treated cellulosic areas cationic. The presence of the choline chloride serves to make the finished fabric both accessible and attractive to anionic cellulose dyestuffs. Choline chloride contains both a reactive primary alcohol group as well as positively charged quaternary group.

With respect to preparing fabric areas which are crosslinked with grafted anionic groups, the treating formulation consists of crosslinking agent, a hydroxycarboxylic acid and an added metal salt catalyst (optional). Crosslinking agents used for this purpose can be the same as those listed supra for cationic treatment. Examples of hydroxy carboxylic acids include citric acid, glycolic acid, malic acid and gluconic acid. Small amounts of metal salt catalyst may be added to augment the catalystic activity of the hydroxy carboxylic acids.

The function of this type treatment is twofold. First, the grafted anionic groups will permit dyeing with cationic dyes during the dye sequence. Secondly, it will impart a resistivity to anionic dyes (except for those which also have a cationic group.)

The third component is the unmodified cotton component. This may be unmodified or in some instances such fabric areas or yarns may be treated with a light basic treatment. The function of this treatment such as with sodium acetate or sodium carbonate is to prevent crosslinking in undesired areas should migration occur in pressing or steaming or other operations prior to curing of the crosslinking agent.

Various approaches may be used to place differently treated cotton yarn into the fabric. First, one could utilize yarns that are cationic (1), anionic (2) or unmodified (3) in woven or knit fabrics. For example, one could knit two inches of a tubular knit with cationic yarn (1) then knit two inches with unmodified cotton yarn (2) or any combination of the three yarns. One might also consider weaving a filling faced sateen, in which two inches of filling are cationic yarn (1), then two inches of anionic yarn (2) and then repeated each type yarn in sequence.

Obviously, one might combine any combination of the three yarn types mentioned in desired sequence. One could also print areas of the fabric with treatments containing crosslinking agent acid catalyst and choline chloride. Once these treatments are cured and laundered, multicolored cotton fabrics are produce by piece dyeing.

In this instance, the cationic areas of the fabric are then dyed under mildly acidic conditions with a reactive, direct or other dye containing an anionic group. Then, the fabric is dyed with a reactive dye of a second color under alkaline conditions. This second dyeing would dye both the cationic and unmodified cotton whereas the dyeing under acid conditions would deep dye the cationic areas and only shade at most the untreated areas. By proper selection of dye colors and concentrations, one skilled in the art of dyeing could produce fabric of numerous color combinations from one type of fabric via piece dyeing. It should also be noted that the order of dyeing could be reversed and a bicolored fabric would be obtained.

Similarly, in instances in which the cellulosic fabrics contains crosslinked areas with anionic groups one could use a combination of dyeing with an anionic dye under acid conditions and dyeing with a cationic dye under acid conditions to produce a bicolored durable press fabric. For example, one might dye first with the anionic dye, then dye with the cationic dye.

One might also immerse dye a crosslinked fabric with separate cationic and anionic areas. In this instance a stable dye bath containing anionic and cationic dyes of different colors is necessary. Dyeing with a reactive dye under alkaline conditions and a cationic dye under acid conditions could also be employed to achieve a bicolored fabric.

Using a fabric containing three types of cotton areas: (1) cationic; (2) anionic; (3) unmodified; one can produce a three colored fabric by the following procedure: (1) dyeing with an anionic dye under acidic conditions; (2) dyeing with a reactive dye under alkaline conditions; and (3) dyeing with a cationic dye under adidic conditions.

The three following dye procedures were utilized in the examples of the preferred embodiments. dye procedure A wherein a mildly acidic wool dye bath in which up to 4 grams of dye per 100 grams fabric is used with a maximum bath temperature of 75° C.

Dye procedure B is used in dyeing with reactive dyes under alkaline conditions. Up to 4 grams of dye per 100 grams of fabric is used, a maximum bath temperature is 60° C. and sodium carbonate is used as a catalyst. Dye procedure B is used when dyeing with reactive dyes using alkaline conditions and from 0.2 to 4 grams of dye per 100 grams of fabric being dyed. Dye procedure C is used in dyeing fabric with a cationic dye under acidic conditions. Up to 10 grams of dye per 100 grams of fabric is used and a maximum bath temperature of 85° C.

Cellulosic fabric or yarn can be either greige or prepared fabric (desized, scoured and bleached), mercerized or fabric or yarns which have been treated with liquid ammonia. Caustic mercerized yarn are preferable to achieve depth of shade in dyeing. A pad dry-cure treatment is applied to the selected cellulosic yarns or fabric. The finish comprises a crosslinking agent, catalyst, appropriate reactive additive and any selected auxiliaries such as wetting agents, softeners or thickeners.

The amount of crosslinking agent and additive can be varied over a wide range depending upon the level of dye uptake and smooth-dry performance desired. This process differs from other crossdyed cotton systems based on cationic groups in that some or all of the fibres in the final fabric are crosslinked and that a level of improved smooth dry performance is achieved. Other versions of this development might be noted. For example, if the crosslinking agent, acid catalyst and choline are applied to fabric in stripe form, the fabric is cured, washed and dyed with reactive dyes (two colors) under both acidic and alkaline conditions, a bicolored seersucker-like fabric is achieved. Similarly, if the treatment is applied to one side of the fabric, then cured and washed a smooth-dry fabric is achieved. then, the fabric can be dyed with reactive dyes (two colors) under both acidic and alkaline conditions, a bicolored smooth dry fabric results.

Another approach is to apply the treating solution by injection in a cone of yarn, dry the yarn, use this yarn in preparing a knit or woven fabric and cure said fabric. The fabric is then dyed with reactive dyes under both acidic and alkaline conditions. There is produced a variegated two - three color fabric in which the cationically treated areas are various shades of the dye used in dyeing under acidic conditions and the remainder of the fabric primarily reflects the color of dye employed in dyeing under alkaline conditions. Fabrics with a very nonuniform multicolor pattern are produced in this case.

EXAMPLE 1

Multicolored Dyeing Of Knitted Fabrics Prepared From Treated And Untreated Yarns A pad bath was prepared containing 2% trimethylol acetylenediureine, 5% choline chloride, 2% magnesium chloride hexahydrate, 0.1% nonionic wetting agent and the remainder water. A mercerized cotton yarn was padded with this formulation using a yarn treatment apparatus and the padded yarn was dried. Then, this yarn and untreated mercerized yarn were used to knit a jersey tube. Treated and untreated yarns were alternated every two inches in the fabric. The fabric was then pressed, and cured for 3 minutes at 160° C. and laundered. A one foot length of the fabric was then dyed with Reactive Red 2 using dye Procedure A (mildly acidic) conditions. the fabric was washed. The same fabric was then dyed with Reactive Yellow 27 using dye procedure B (alkaline conditions). The result was a bicolored striped fabric, which alternated two inch segments of red and yellow.

Another 1 ft sample of undyed fabric was dyed with 4% reactive Blue 29 under acidic conditions using dye procedure A, washed and redyed with 2% Reactive Yellow 27 under alkaline conditions. The result was a bicolored striped fabric, which alternated two inch segments of greenish blue, and yellow.

Another 1 ft sample of undyed fabric was dyed with Reactive Red 40 under acidic conditions using dye procedure A, washed and redyed with Reactive Blue 29 under alkaline conditions. The result was a bicolored striped fabric, with alternate two inch segments of a deep red and blue.

These results show clear indication that color of the cationic areas is influenced by both dyeings, but primarily by dye procedure A.

EXAMPLE 2

Multicolored Dyeing Of Woven Fabrics Prepared From Treated And Untreated Yarns A pad bath was prepared containing 3% trimethylol acetylenedieureine, 5% choline chloride, 2% magnesium chloride hexahydrate, 0.1% citric acid, 0.1% nonionic wetting agent and the remainder water. A mercerized cotton yarn was padded with this formulation using a yarn treatment apparatus and the padded yarn was dried. Then, this yarn and untreated mercerized yarn were used as filling yarns in a filling faced sateen. The treated yarns and untreated yarns were alternated every two inches in the fabric. the fabric was then pressed and cured for 4 minutes at 160° C. and laundered. A 1 ft length (4 inches wide) sample was then dyed with 4% Reactive Blue 29 using dye procedure A (mildly acidic conditions). The fabric was washed. The same fabric was then dyed with 3% Reactive Yellow 27 using dye procedure B (alkaline conditions). The result was a bicolored filling faced sateen in which every two inches were alternately blue and yellow stripes. The back of the fabric was predominately yellow except where the blue fill showed through because the warp yarns were dyed yellow.

A similar procedure was repeated on another undyed sample of filling faced sateen using 4% Reactive Red 2 with dye procedure A (mildly acidic conditions) and 2% Reactive Yellow 27 with dye procedure B (alkaline conditions). The result was a bicolored filling faced sateen in which every two inches were alternately red and yellow stripes. The reverse procedure was repeated with a sample of undyed sateen using first 4% Yellow 27 with dye procedure B then 4% Reactive Red 2 with dye procedure A and yielded a bicolored filling faced sateen in which every two inches were alternately red and yellow stripes.

Another undyed sample of filling faced sateen was dyed first with 4% Reactive Red 2 with dye procedure A (mildly acidic conditions), washed and then dyed with 2% Reactive Blue 29 with dye procedure B (alkaline conditions). The result was a bicolored filling faced sateen in which every two inches were alternately dark red and blue stripes.

Therefore, these results show that by the dual dye procedure a bicolored cotton fabric can be achieved by immersion dyeing.

EXAMPLE 3

Multicolored Dyeing Of Woven Fabrics Prepared From Treated And Untreated yarns A pad bath was prepared containing 3% trimethylol acetylenediureine, 5% choline chloride, 2% magnesium chloride hexahydrate, 0.1% citric acid, 0.1% nonionic wetting agent and the remainder water. A mercerized cotton yarn was padded with this formulation using a yarn treatment apparatus and the padded yarn was dried. Then, this yarn was used as the filling in a plain weave fabric. The fabric was then pressed and cured for 4 minutes at 160° C. and laundered. A one foot length of 4 inch wide fabric was then dyed using 4% Reactive Red 2 with dye procedure A (mildly acidic conditions), washed and then dyed using 2% reactive Yellow 27 with dye procedure B (alkaline conditions). The result was a red and yellow crossdyed fabric in which the filling yarns were dyed red and the warp yarns were dyed yellow.

The same sequence was repeated with another sample of the plain weave fabric except that 4% Reactive Blue 29 was used with dye procedure A and 2% Reactive Yellow 27 was used with dye procedure B. The result was a blue and yellow crossdyed fabric in which the filling yarns were dyed blue and the warp yarns were yellow.

The same overall procedure was used with another sample of undyed plain weave fabric except that the 4% Reactive Red was used with dye procedure A and 2% Reactive Blue 29 was used with dye procedure B (alkaline conditions). The result was a bicolored plain weave fabric in which the filling yarns were dyed a deep red and the warp yarns were dyed blue.

These results clearly demonstrate that a crossdyed woven fabric was achieved via two successive immersion dyeings.

EXAMPLE 4

Tricolor Crossdyeing Of Knitted Fabrics Prepared From Treated And Untreated Yarns A pad bath was prepared containing 3% trimethylol acetylenediureine, 5% choline chloride, 2% magnesium chloride hexahydrate, 0.10% citric acid, 0.1% nonionic wetting agent and the remainder water. A mercerized cotton yarn was padded with this formulation using a yarn treatment apparatus and the padded yarn was dried. A second pad bath was prepared containing 3% trimethylol acetylenediureine, 2% citric acid, 0.2% magnesium chloride hexahydrate, 0.1% nonionic wetting agent and the remainder water. A second mercerized cotton yarn was padded with this second formulation using a yarn treatment apparatus and the padded yarn was dried.

Then, these separate yarns together with an untreated mercerized cotton were knitted into a jersey tube in which the three yarns were alternated in the knit after each two inch segments. The final knitted fabric was then pressed, cured for 4 minutes at 160° C. and laundered. A one foot length of this fabric was then dyed with 4% Reactive Red 2 using dye procedure A (mildly acidic conditions). The fabric was washed, then redyed with 2% Reactive Yellow 27 using dye procedure B (alkaline conditions. The result was tricolored: bright red, yellow and off-white striped fabric in which the cationic segment were dyed red, the untreated cotton was dyed yellow and the segments crosslinked with an anionic graft were off-white.

Similarly, if an undyed sample of this 3 component knit is first dyed with 4% Reactive Red 40 using dye procedure A (mildly acidic conditions), then dyed with 1% Reactive Blue 29 using dye procedure B, laundered then dyed with 3% Basic Yellow 63 using dye procedure C. The result is a tricolored fabric, red, blue and yellow, which has been produced by immersion dyeing of an all cotton fabric.

If another sample of this 3 component knit is first dyed with 4% Reactive Blue 29 using dye procedure A, laundered then 2% Reactive Yellow 27 using dye procedure B, the result is a tricolored fabric which is blue, yellow and white, reflecting the cationic, untreated and anionic areas of the fabric.

Conversely, if the undyed 3-component knit is first dyed with Reactive Blue 29 using dye procedure A, laundered, then dyed with 3% Basic Yellow 63, the result is a tricolored knit which was dark blue, pale blue and yellow reflecting the cationic, untreated and anionic areas of the knit.

Similarly, if another undyed sample of the 3-component knit is first dyed with 4% Reactive Red 40 using dye procedure A, laundered, then dyed with 3% Basic Yellow 63, the result is a tricolored knit which was dark red, pale pink and yellow reflecting the cationic, untreated and anionic areas of the knit.

EXAMPLE 5

A Multicolored Crossdyeable Knitted Fabric Prepared From Treated Yarns

A pad bath was prepared containing 3% trimethylol acetylenediureine, 5% choline chloride, 2% magnesium chloride hehahydrate, 0.10% citric acid, 0.1% nonionic wetting agent and the remainder water. A mercerized cotton yarn was padded with this formulation using a yarn treatment apparatus and the padded yarn was dried. A second pad bath was prepared containing 3% trimethylol acetylenediureine, 2% citric acid, 0.2% magnesium chloride hehahydrate, 0.1% nonionic wetting agent and the remainder water. A second mercerized cotton yarn was padded with this second formulation using a yarn treatment apparatus and the padded yarn was dried. Then, these separate yarns were knitted into a jersey tube in which the two separately treated yarns were alternated in the knit after each two inch segment. The final knitted fabric was then pressed, cured for 4 minutes at 160° C. and laundered. A one foot length of this fabric was then dyed with Reactive Blue 29 using dye procedure A, laundered then dyed with 10% Basic Yellow 63 using dye procedure C. The result was a green and yellow striped fabric in which the cationic areas were dyed green and the anionic areas were dyed yellow. Because both areas of the fabric were crosslinked, it should be noted that this is a multicolored crossdyeable fabric in which all-segments are crosslinked and that this represents a crossdyeable cotton with easy care or wash wear performance.

Another undyed sample of this jersey tube was dyed in a single bath using dye procedure C. This dye bath contained both 4% Reactive Blue 29 and a 4% Basic Red 46. The result was a blue and pink striped fabric in which the cationic areas were colored by the blue reactive dye and the anionic areas were colored with the red basic dye. Again, this is an example of a crossdyeable smooth-dry fabric.

EXAMPLE 6

A Multicolored Crossdyeable Woven Fabric Prepared From Treated And Untreated Yarns A pad bath was prepared containing 3% trimethylol acetylenediureine, 5% choline chloride, 2% magnesium chloride hexahydrate, 0.10% citric acid, 0.1% nonionic wetting agent and the remainder water. A mercerized cotton yarn was padded with this formulation using a yarn treatment apparatus and the padded yarn was dried. A second pad bath was prepared containing 3% trimethylol acetylenediureine, 2% citric acid, 0.2% magnesium chloride hehahydrate, 0.1% nonionic wetting agent and the remainder water. A second mercerized cotton yarn was padded with this second formulation using a yarn treatment apparatus and the padded yarn was dried. Then, these separate yarns were used as filling yarns in a filling faced sateen in which the two separately treated yarns were alternated in the fabric filling after two inch segment. The final woven fabric was then pressed, cured for 4 minutes at 160° C. and laundered. A one foot length of this fabric was then dyed with 4% Reactive Blue 29 using dye procedure A. Then, the fabric was laundered and redyed with 10% Basic Yellow 63 using dye procedure C. The result was a fabric in which the face was green and yellow because of the dyeing of the cationic (green) and anionic (yellow) areas. On the other hand the warp yarns (untreated cotton) were relatively undyed.

If instead, the second dyeing was performed with 3% Basic Yellow 63 using dye procedure C, there was produced blue and yellow crossdyed fabric with easy care performance.

EXAMPLE 7

Multicolored Knitted Fabric Prepared From Specially Modified Yarns

A pad bath was prepared containing 3% trimethylol acetylenediureine, 5% choline chloride, 2% magnesium chloride hexahydrate, 0.10% citric acid, 0 1% nonionic wetting agent and the remainder water. A mercerized cotton yarn was padded with this formulation using a yarn treatment apparatus and the padded yarn was dried. A second pad bath was prepared containing 1% sodium acetate and 0.1% nonionic wetting agent and remainder water. A second mercerized cotton yarn was padded with this second formulation using a yarn treatment apparatus and the padded yarn was dried. Then, these separate yarns were knitted into a jersey tube in which the two separately treated yarns were alternated in the knit after each two inch segment. The final knitted fabric was then pressed, cured for 4 minutes at 160° C. and laundered. A one foot length of this fabric was then dyed with 2% Reactive Yellow 27 using dye procedure B (alkaline conditions), washing fabric, then redyeing with 4% Reactive Blue 29 using dye procedure A. The result was a green and yellow crossdyed fabric in which the unmodified areas (sodium acetate treated) were a particularly clear and bright yellow.

EXAMPLE 8

Crossdyeing Of Printed Fabrics

A print formulation was prepared that contained 4% trimethylol acetylelediureine, 5% choline chloride, 0.5% hydroxyethylcellulose, 2% magnesium chloride hehahydrate, 0.1% citric acid, 0.1% nonionic wetting agent and the remainder water. This formulation was applied to a cotton print cloth in the form of stripes, letters, numbers and words on the samples. Samples were then dried, cured and laundered as in Example 1. A sample of the fabric was dyed with Reactive Red 2 using dye procedure A, laundered and redyed with Reactive Yellow 27 using dye procedure B. The result was a red and yellow fabric in which the printed areas were dyed red and the untreated portions was dyed yellow. Another sample of the undyed printed printcloth was dyed with Reactive Blue 29 using dye procedure A, laundered and redyed with Reactive Yellow 27 using dye procedure B. The result was a blue and yellow fabric in which the printed areas were dyed blue and the untreated areas were dyed yellow. This example demonstrates that this procedure can be used to achieve crossdyed effects on printed fabrics.

EXAMPLE 9

Variegated Multicolored Knitted Fabric Prepared From Specially Modified Yarns A solution was prepared containing 3% trimethylol acetylenediureine, 5% choline chloride, 2% magnesium chloride hexahydrate, 0.10% citric acid, 0.1% nonionic wetting agent and the remainder water. A mercerized cotton yarn was injected with this formulation using a syringe and the yarn was dried. Then, this yarn was knitted into a jersey tube. The final knitted fabric was then pressed, cured for 4 minutes at 160° C. and laundered. A one foot length of this fabric was then dyed with Reactive Red 2 using dye procedure A, laundered and redyed with Reactive Yellow 27 using dye procedure B. The result was a variegated red and yellow fabric in which the treated yarn segments were dyed various shades of red and the untreated portions was dyed yellow. Another one foot sample of the undyed knit was dyed with Reactive Blue 29 using dye procedure A, laundered and redyed with Reactive Yellow 27 using dye procedure B. The result was a variegated blue and yellow fabric in which the treated yarn segments were dyed various shades of blue and the untreated areas were dyed yellow. This example demonstrates the this procedure can be used to achieve special crossdyed effects on knit fabrics.

I claim:

1. A process for crossdyeing a cellulosic fabric comprising:

(a) treating preselected areas of a cellulosic fabric with an aqueous cationic solution of sufficient concentrations of: N-methylol crosslinking agent, acid catalyst and a choline quaternary, and drying and curing said fabric for sufficient time and temperature to impart cationic properties to said treated areas of fabric;

(b) immersing the fabric in an acidic dyebath containing an anionic dye for sufficient time to allow the anionic dye to react with the cationic areas and thereby produce a fabric which is dyed only in the treated areas and washing the fabric to remove unreacted dyestuffs from the fabric; then, (c) immersing the fabric in an alkaline dyebath containing a reactive dyestuff of different color than that of step (b) for sufficient time to dye the fabric and thereby produce a bicolored fabric.

2. The process of claim 1 wherein the cellulosic fabric is cotton.

3. The process of claim 1 wherein the areas preselected to be cationic area treated by printing or coating.

4. The process of claim 1 wherein the cationic preselected areas of cellulosic fabric are produced from yarn which is pretreated to be cationic upon curing and the untreated areas of cellulosic fabric are produced from untreated yarn.

5. The process of claim 1 including a step of treating the noncationic areas of cellulosic fabric with an alkali solution prior to drying and curing the fabric in step (a) thereby preventing crosslinking on any noncationic areas.

6. The process of claim 1 wherein the N-methylol crosslinking agent is selected from the group consisting of: dimethylol dihydroxyethyleneurea, methoxylated dimethylol dihydroxyethyleneurea, trimethylol acetylenediureine, tetramethylol acetylenediureine, methylol melamine, methylol dicarbamate of pentaerythritol and dimethylol propylcarbamate.

7. The process of claim 1 wherein the acid catalyst is selected from the group consisting of: zinc nitrate hexahydrate, magnesium chloride hexahydrate, and mixed catalyst of magnesium chloride hexahydrate and citric acid.

8. The process of claim 1 wherein the anionic dyestuff is selected from the group consisting of: reactive, direct, acid and acid metalized dyes.

9. The process of claim 5 wherein the alkali is selected from the group consisting of sodium acetate, sodium carbonate and sodium hydroxide.

10. A process for crossdyeing a crosslinked cellulose fabric comprising:

(a) treating preselected areas of cellulose fabric with an aqueous cationic solution of sufficient concentration of: N-methylol crosslinking agent, acid catalyst and choline quaternary to render said preselected areas cationic after curing;

(b) drying the fabric of (a) and treating the remaining areas of the fabric with an aqueous anionic solution of sufficient concentrations of: N-methylol crosslinking agent, acid catalyst and hydroxycarboxylic to render said preselected areas anionic after curing;

(c) drying and curing the fabric of (b);

(d) immersing the fabric in an acidic dyebath containing an anionic dye for sufficient time to allow the anionic dye to react with the cationic areas and thereby produce a fabric colored in the cationic areas; and (e) immersing the fabric in a dyebath containing a cationic dye of a different color for sufficient time to allow the cationic dye to react with the anionic areas and thereby produce a bicolored fabric.

11. The process of claim 10 including the step of washing and removing the reactive dyestuffs from the fabric after step (d).

12. The process of claim 10 wherein the cellulosic fabric is cotton.

13. The process of claim 10 wherein the cationic and anionic areas are treated by printing or coating.

14. The process of claim 10 wherein the cationic preselected areas of cellulosic fabric are produced from yarn which is pretreated to be cationic upon curing and the anionic preselected areas of celulosic fabric are produced from yarn which is pretreated to be anionic upon curing.

15. The process of claim 10 wherein the N-methylol crosslinking agent is selected from the group consisting of: dimethylol dihydroxyethyleneurea, methoxylated dimethylol dihydroxyethyleneurea, trimethylol acetylenediureine, tetramethylol acetylenediureine, methylol melamine, methylol dicarbamate of pentaerythritol and dimethylol propylcarbamate.

16. The process of claim 10 wherein the acid catalyst is selected from the group consisting of: zinc nitrate hexahydrate, magnesium chloride hexahydrate, and mixed catalyst of magnesiumn chloride hexahydrate and citric acid.

17. The process of claim 10 wherein the hydroxycarboxylic acid is selected from the group consisting of: citric acid, glycolic acid, malic acid and gluconic acid.

18. The process of claim 10 wherein the anionic dyestuff is selected from the group consisting of: reactive, direct, acid and acid metalized dyes.

19. A process for crossdyeing a partially crosslinked fabric with cationic, anionic and untreated preselected areas comprising:

(a) treating preselected areas of a cellulosic fabric with an aqueuous cationic solution of sufficient concentrations of: N-methylol crosslinking agent, acid catalyst and choline quaternary to render said preselected areas cationic after curing;

(b) drying the fabric of (a) and treating other preselected areas of the fabric with an aqueous anionic solution of sufficient concentrations of: N-methylol crosslinking agent, hydroxycarboxylic acid and acid catalyst to render said remaining areas anionic after curing;

(c) drying and curing the fabric if (b);

(d) immersing the fabric in an acidic dyebath containing an anionic dye for sufficient time to allow the anionic dye to react with the cationic areas and thereby produce a fabric which is dyed only in the cationically treated areas and washing the fabric to remove unreacted dyestuffs from the fabric;

(e) immersing the fabric in an alkaline dyebath containing a reactive dyestuff of different color than that of step (d) for sufficient time to modify the dyed cationic area, and the the untreated area of the fabric thereby producing a tricolored fabric wherein the cationic areas are one color, the untreated areas are a different color and the anionic areas are undyed.

20. The process of claim 19 including washing the unreacted dyestuffs from the fabric of step (e).

21. The process of claim 19 wherein the cationic and anionic areas area treated by printing or coating.

22. The process of claim 19 wherein the cationic preselected areas of cellulosic fabric are produced from yarn which is pretreated to be cationic upon curing and the anionic preselected areas of cellulosic fabric area produced from yarn which is pretreated to be anionic upon curing.

23. The process of claim 20 including immersing the fabric in a dyebath containing a cationic dye of a third color for sufficient time to allow the cationic dye to react with the anionic areas and thereby produce a tricolored fabric wherein the cationic areas are one color, the untreated areas area a second color and the anionic areas are a third color.

* * * * *